US005831187A

United States Patent [19]

Flinn

[11] Patent Number: 5,831,187

[45] Date of Patent: Nov. 3, 1998

[54] ADVANCED NICKEL BASE ALLOYS FOR HIGH STRENGTH, CORROSION APPLICATIONS

[75] Inventor: John E. Flinn, Idaho Falls, Id.

[73] Assignee: Lockheed Idaho Technologies Company, Idaho Falls, Id.

[21] Appl. No.: 638,255

[22] Filed: Apr. 26, 1996

[51] Int. Cl.[6] ..... G22C 19/05

[52] U.S. Cl. ..... 75/246; 75/243; 75/244; 420/453; 420/459

[58] Field of Search ..... 75/246, 243, 244; 420/453, 459

[56] References Cited

U.S. PATENT DOCUMENTS

| | | | |
|---|---|---|---|
| 3,046,108 | 7/1962 | Eiselstein et al. | 420/448 |
| 3,160,500 | 12/1964 | Eiselstein et al. | 420/448 |
| 4,118,223 | 10/1978 | Acuncius et al. | 420/443 |
| 4,731,117 | 3/1988 | Stulga et al. | 75/243 |
| 4,750,950 | 6/1988 | Clatworthy et al. | 148/707 |
| 5,000,914 | 3/1991 | Igarashi et al. | 420/451 |
| 5,217,684 | 6/1993 | Igarashi et al. | 420/448 |
| 5,556,594 | 9/1996 | Frank et al. | 420/448 |

OTHER PUBLICATIONS

Eiselstein, H.L., et al *The Invention and Definition of Alloy 625,* Superalloys 718, 625 and Various Derivatives, E. A. Loria, Ed., The Minerals, Metals & Materials Society, 1991.

Rizzo, F. J., et al *Microstructural Characterization of PM 625–Type Materials,* Superalloys 718, 625 and Various Derivatives, E. A. Loria, Ed., The Minerals, Metals & Materials Society, 1991.

Frant, R. B., *Custom Age 625 Plus Alloy—A Higher Strength Alternative to Alloy 625,* Superalloys 718, 625 and Various Derivatives, E. A. Loria, Ed., The Minerals, Metals & Materials Society, 1991.

*Primary Examiner*—Ngoclan Mai

*Attorney, Agent, or Firm*—Armstrong Westerman Hattori McLeland & Naughton

[57] ABSTRACT

Improved nickel-base alloys of enhanced strength and corrosion resistance, produced by atomization of an alloy melt under an inert gas atmosphere and of composition 0–20Fe, 10–30Cr, 2–12Mo, 6 max. Nb, 0.05–3 V, 0.08 max. Mn, 0.5 max. Si, less than 0.01 each of Al and Ti, less than 0.05 each of P and S, 0.01–0.08C, less than 0.2N, 0.1 max. 0, bal. Ni.

7 Claims, 2 Drawing Sheets

ADVANCED NICKEL BASE ALLOYS FOR HIGH STRENGTH, CORROSION APPLICATIONS

CONTRACTUAL ORIGIN OF THE INVENTION

The United States Government has rights in this invention pursuant to Contract No. DE-AC07-94ID13223 between Lockheed Idaho Technologies Company and The United States Department of Energy.

BACKGROUND OF THE INVENTION

1. Field of the Invention

This invention relates to improved high strength, corrosion-resistant nickel base alloys of retained ductility and containing vanadium and/or niobium and having restricted contents of aluminum and titanium.

2. Prior Art

Efforts have been made over the past thirty years or so to develop alloys having high strength and resistant to many corrosive environments. Prominent among such alloys are nickel-base alloys, including the so-called "superalloys." Representative of such alloys is Alloy 625, a Ni—Cr—Mo—Nb alloy developed by the International Nickel Co. (INCO). The same efforts resulted in Alloy 718, a Ni—Fe—Cr—Mo—Nb alloy with relatively high Al and Ti contents. "The Invention and Definition of Alloy 625, H. L. Eiselstein and D. J. Tillack, Inco Alloys International, Inc., P.O. Box 1958, Huntington, W. Va. "Superalloys 718, 625 and Various Derivatives," E. A. Loria, ed., The Metals Society, Warrendale, Pa. (1991), pages 1–14 .

At least some of these alloys, such as Alloy 625, have been produced by powder metallurgy techniques for controlled strengthening by conventional heat treatments. F. J. Rizzo and J. Radavich, *Microstructural Characterization of PM 625-Type Materials*, Crucible Compaction Metals, McKee and Robb Hill Roads, Oakdale, Pa. 15071 and Purdue University, West Lafayette, Ind. 47906.

Modifications have been made to at least some of these alloys, such as 625 Plus Alloy, nominally 21Cr-8Mo-3.4Nb-1.3Ti-0.2Al-5Fe-bal.Ni, to achieve still higher strength with corrosion resistance at least comparable to the unmodified alloy. *Custom Age 625 Plus Alloy—A Higher Strength Alternative to Alloy* 625, R. B. Frank, Carpenter Technology Corporation, P.O. Box. 14662, Reading, Pa. 19612.

The trademarked Hastelloys, nickel-based alloys, have been commercially available for some time for high strength performance in corrosive environment applications.

Still further improvement is needed in strength properties with good corrosion resistance and retained ductility for many high performance applications.

SUMMARY OF THE INVENTION

The invention relates to a new class of nickel-base alloys produced by atomization of an alloy melt under cover of an inert gas. These alloys include a corrosion-resistant superalloy of nominal composition 25Cr-15Fe-5.5Nb-3Mo-0.07C-bal.Ni which obtains its strength largely from precipitation hardening by the intermetallic phase gamma" ($Ni_3Nb$), and an alloy comprising 25Cr-10Mo-4Fe-0.5V-0.5Nb-0.6C-0.15N-bal.Ni competitive with the corrosion resistant Hastelloys.

DESCRIPTION OF PREFERRED EMBODIMENTS

Figure 1A:
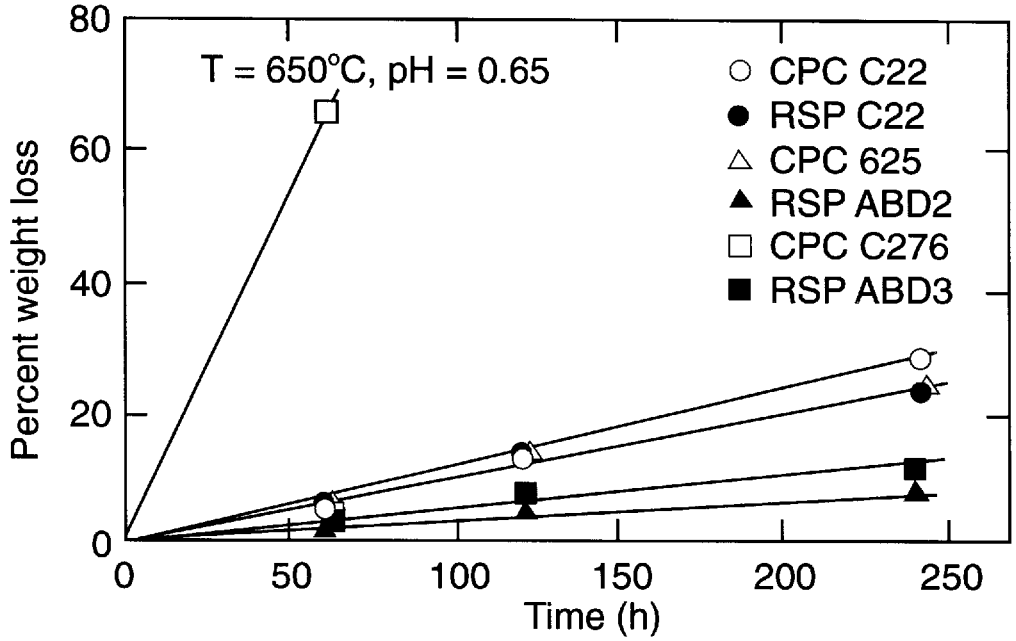
FIGS. 1A–1C are graphs relating percent corrosion weight loss and time for an alloy of the invention and comparison commercial alloys pursuant to supercritical water oxidation tests.

A number of experimental and comparison alloys were prepared, the compositions of which are shown in Table 1.

TABLE 1

| Alloy | | Nominal Composition, Weight Percent | | | | | | | | | | |
|---|---|---|---|---|---|---|---|---|---|---|---|---|
| C | N | Ni | Fe | Cr | Mo | Nb | V | W | Co | Mn | Ti | Al |
| ABD2 | | Bal. | 15 | 25 | 3 | 5.5 | — | — | — | 0.5 | — | — |
| 0.07 | 0.01 | | | | | | | | | | | |
| 625 | | Bal. | 3 | 22 | 9 | 3.4 | — | — | — | 0.05 | 0.3 | 0.2 |
| 0.02 | — | | | | | | | | | | | |
| 718 | | Bal. | 19 | 19 | 3 | 5.1 | — | — | — | 0.3 | 1.0 | 0.6 |
| 0.04 | — | | | | | | | | | | | |
| ABD5 | | Bal. | 4 | 25 | 10 | 0.5 | 0.5 | — | — | 0.5 | — | — |
| 0.06 | 0.15 | | | | | | | | | | | |
| C22[a] | | Bal. | 3 | 22 | 13 | — | 0.5 | 3 | 2.5 | 0.5 | — | — |
| 0.02 | — | | | | | | | | | | | |
| C276[a] | | Bal. | 5 | 16 | 15.4 | — | 0.1 | 3.3 | 1.4 | 0.5 | — | — |
| 0.003 | — | | | | | | | | | | | |

[a]Hastelloy alloys

For the experimental alloys ABD2 and ABD5, powders for each alloy were prepared by induction melting of 15 pound ingots. Alloy ABD2 was melted under argon, whereas Alloy ABD5 was melted under nitrogen. The temperature of the melts prior to gas atomization was about 1700° C., representing a superheat of about 250° C. Gas atomization involved the use of helium (Alloy ABD2) or nitrogen (Alloy ABD5). The rapidly solidified powders (RSP) from each run were consolidated into bars by hot extrusion involving an extrusion ratio of 10 to 1. The extruded powders exhibited full densification with no evidence of porosity or prior particle boundaries. Ingot material for each experimental alloy was also extruded for comparison with the consolidated powders.

Conventionallly processed counterparts (CPC) of the gas-atomized alloys of the invention were prepared by conventional ingot metallurgical practice, and some of the commercial alloys were prepared also in the form of gas atomized powders followed by consolidation by extrusion.

The size and temperature stability of alloy grains is important for obtaining and retaining alloy strength at elevated temperatures. One hour heat treatments, between 1000° to 1300° C., followed by a water quench, were performed on the two experimental consolidated alloy powders and also on the conventionally processed counterparts (CPC) of those alloys. Microstructural examinations, including grain size measurements on polished and etched metallographic specimens, were performed after the 1 hour heat treatments. The average grain sizes are shown in Table 2.

TABLE 2

| Alloy | Grain Size, mm 1000° C. | 1100° C. | 1200° C. | 1300° C. |
|---|---|---|---|---|
| ABD2-RSP[a] | 0.005 | 0.011 | 0.016 | —[b] |
| ABD2-CPC[c] | 0.020 | 0.034 | 0.099 | —[b] |
| ABD5-RSP[a] | 0.005 | 0.006 | 0.009 | 0.036 |
| ABD5-CPC[c] | 0.022 | 0.030 | 0.042 | 0.106 |

[a]Rapidly solidified powder, according to the invention.
[b]Not determined
[c]Conventionally processed counterpart.

The results of such tests show that the grain sizes for the rapidly solidified experimental alloys are considerably smaller and more stable at high temperatures than their conventionally processed counterparts.

The superalloy, ABD2, was given further, time-at-temperature aging heat treatments for precipitation of the intermetallic, gamma" phase ($Ni_3Nb$). Maximum hardness was observed after a 675° C., 50 hour aging treatment.

Tensile properties for the experimental alloys, after testing at room temperature, 600° C. and 800° C., are shown in Table 3.

TABLE 3

| Alloy | Heat Treatment | Test Temp., °C. | Stress, MPa Yield | Ultimate | Ductility, % Total Elong. | Red. Area |
|---|---|---|---|---|---|---|
| ABD2-RS | 1100° C./1 hr. | 24 | 500 | 953 | 49 | 53 |
| ABD2-CPC | 1100° C./1 hr. | 24 | 313 | 759 | 57 | 55 |
| ABD2-RS | 1000° C./1 hr. + aging[a] | 24 | 1257 | 1450 | 22 | 36 |
| ABD2-CPC | 1000° C./1 hr. + aging[a] | 24 | 871 | 1120 | 30 | 36 |
| ABD2-RS | 1100° C./1 hr. + aging[a] | 600 | 968 | 1153 | 20 | 24 |
| ABD2-CPC | 1100° C./1 hr. + aging[a] | 600 | 656 | 773 | 10 | — |
| ABD2-RS | 1100° C./1 hr. + aging[a] | 800 | 505 | 514 | 17 | 22 |
| ABD2-CPC | 1100° C./1 hr. + aging[a] | 800 | 394 | 416 | 15 | 16 |
| ABD5-RS | 1200° C./1 hr. | 24 | 515 | 999 | 46 | 44 |
| ABD5-CPC | 1200° C./1 hr. | 24 | 359 | 787 | 70 | 64 |
| ABD5-RS | 1200° C./1 hr. | 600 | 356 | 788 | 39 | 32 |
| ABD5-CPC | 1200° C./1 hr. | 600 | 222 | 597 | 67 | 52 |
| ABD5-RS | 1200° C./1 hr. | 800 | 359 | 440 | 35 | 33 |
| ABD5-CPC | 1200° C./1 hr. | 800 | 206 | 371 | 54 | 45 |

[a]Aging was for 675° C. for 50 hours.

These results clearly show that the rapid solidification processing (RSP) of the alloys produces very significant improvements in strengthening as compared to conventionally processed counterparts. In addition, the strengthening is accompanied by retention of good ductility. The improvements from the rapid solidification processing are attributed, at least in part, to composition homogeneity and fine grain size. The superalloy, ABD2, exhibits the highest level of strengthening, due to the age-hardenability with intermetallic precipitates.

Room temperature tensile property comparisons of the experimental alloys and several commercial nickel-base alloys (compositions given in Table 1) are shown in Table 4.

TABLE 4

| Alloy | Stress, MPa Yield | Ultimate | Percent Total Elong. | Red. in Area |
|---|---|---|---|---|
| 718 (CPC) | 958 | 1344 | 29 | 27 |
| 625 (CPC)[a] | 872 | 1214 | 30 | — |
| 625 (P/M)[b] | 770 | 1152 | 35 | 45 |
| ABD2 (CPC) | 871 | 1120 | 30 | 36 |
| ABD2 (RSP) | 1257 | 1450 | 22 | 36 |
| C22 (CPC)[c] | 310 | 690 | 45 | — |
| C22 (RSP) | 618 | 1049 | 46 | 54 |
| ABD5 (CPC) | 363 | 797 | 61 | 64 |
| ABD5 (RSP) | 657 | 1048 | 37 | 40 |

[a]Eiselstein and Tillack, "The Invention and Definition of Alloy 625," Superalloys 718, 625 and Various Derivatives, Ed. E. A. Loria, The Metals Society, Warrendale, Pa. (1991), pp. 1–14.
[b]Rizzo and Radavich, "Microstructural Characterization of PM 625-Type Materials, Ibid, pp. 297–308.
[c]Data sheet from VOM Nickel-Technologies A6, a company of Krupp Stahl.

The experimental RSP alloys clearly exhibit superior strengthening while retaining ductility.

The new RSP alloys also possess enhanced creep resistance as compared to their conventionally processed counterparts. The stress-to-rupture values for the ABD2-RSP and ABD2-CPC alloys are shown in Table 5.

TABLE 5

| Alloy | Test Temp., °C. | Stress, MPa | Rupture Time, Hrs. |
|---|---|---|---|
| CPC | 650 | 600 | 4.7 |
| RSP | 650 | 600 | 42.5 |
| CPC | 650 | 500 | 40.1 |
| RSP | 650 | 500 | 240.3 |

It is apparent from the Table 5 data that the rapid solidification processing has improved the creep time-to-rupture lifetime for the ABD2 alloy. Creep testing of the ABD5 alloy, at 600° C. and 400 and 450 MPa (58 and 65 ksi), showed rupture times of 881 and 445 hours, respectively. Thus, despite the substantial absence of Al and Ti, which are included in the 625 alloy for deoxidation and creep resistance, the alloys of the invention show good creep resistance.

Figure 1B:
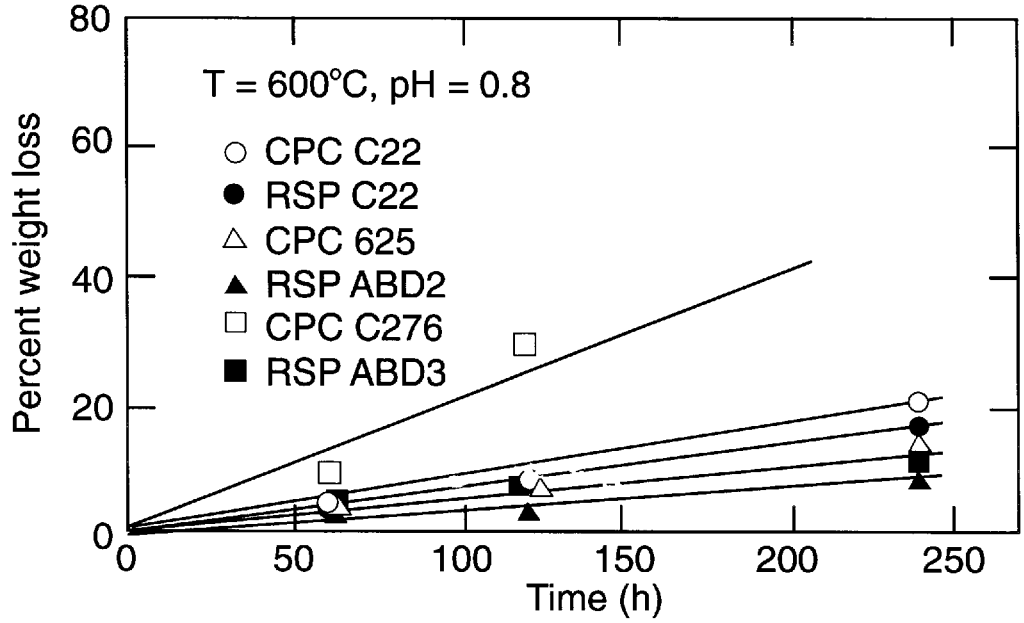
Figure 1C:
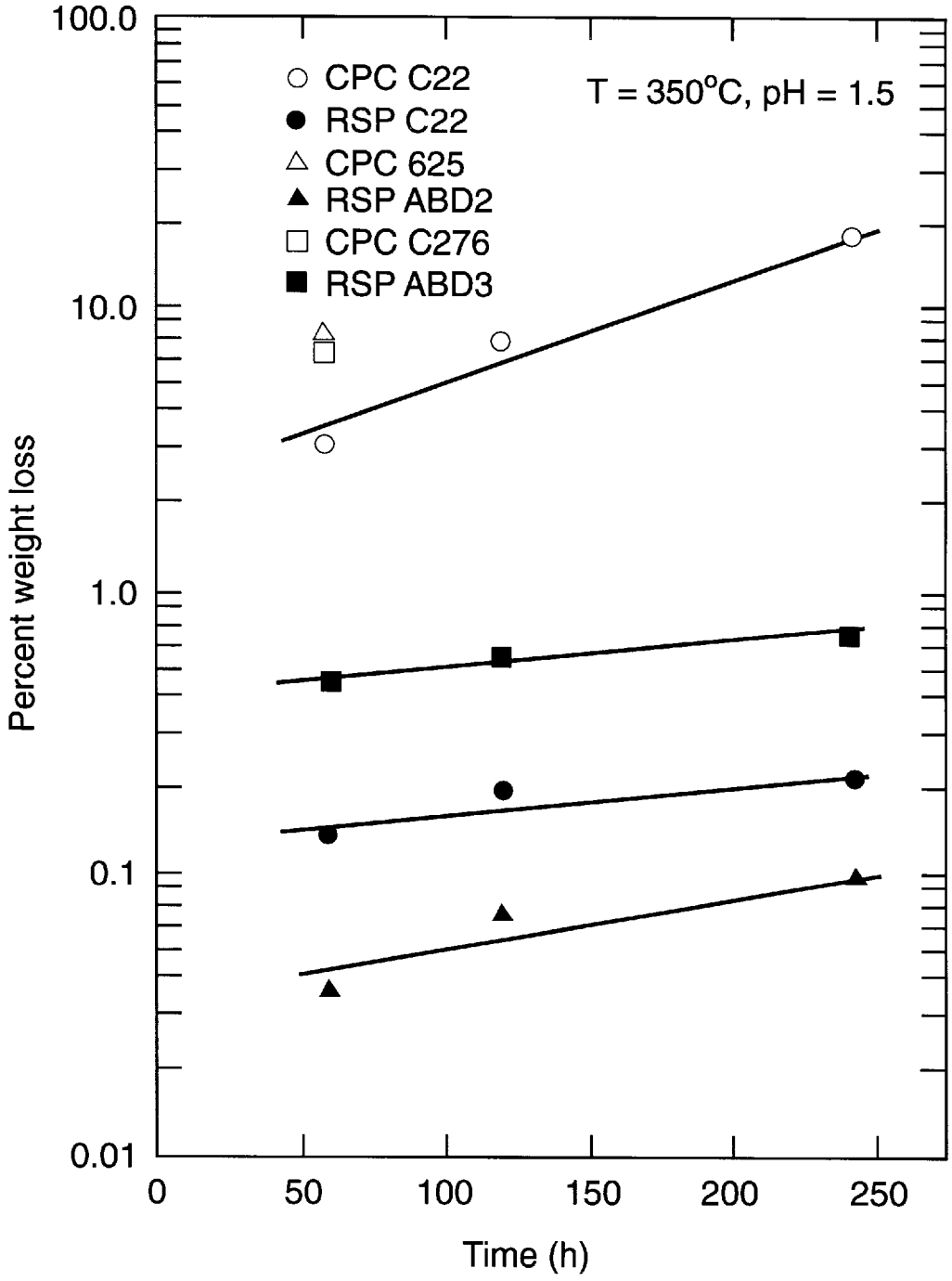

Corrosion tests were performed on the ABD2-RSP consolidated powder in a very hostile supercritical water oxidation/hydrochloric acid environment, at 240 atm. pressure, and under three different temperature and pH conditions: 650° C. and pH 0.65; 600° C. and pH 0.8, and 350° C. and pH 1.5. In these tests, the performance of the ABD2-RSP alloy was compared to the behavior of several commercial, conventionally processed, corrosion-resistant nickel-base alloys (compsitions of which are given in Table 1 above). As shown in FIGS. 1A–1C, the corrosion resistance of the ABD2-RSP alloy exceeded that of conventionally processed nickel-base alloys C276 nickel-base alloy C22 which is especially intended for corrosion-resistant applications.

Most broadly, the alloys of the invention fall within the ranges of elements as shown in Table 6.

TABLE 6

| Element | Weight Percent |
|---|---|
| iron | 0 to 20 |
| chromium | 10 to 30 |
| molybdenum | 2 to 12 |
| niobium | 6 max. |
| vanadium | 3.0 max., preferably 0.05 to 3.0 and most preferably 0.5 to 3.0 |
| manganese | 0.8 max. |
| silicon | 0.5 max. |
| aluminum | less than 0.01 |
| titanium | less than 0.01 |
| phosphorus | less than 0.05 |
| sulfur | less than 0.05 |
| carbon | 0.01 to 0.08 |
| nitrogen | less than 0.2 |
| oxygen | 0.1 max. |
| nickel | balance |

More specifically, within the aforesaid broad range, the permissable range of elements for the ABD2 alloy is given in Table 7, and that for the ABD5 alloy is given in Table 8.

TABLE 7

| Element | Weight Percent |
|---|---|
| iron | 3 to 18 |
| chromium | 18 to 25 |
| molybdenum | 8 max. |
| niobium | 3.5 to 6.0 |
| vanadium | 3.0 max. |
| manganese | 1 max. |
| silicon | 1.0 max. |
| aluminum | 0.01 max. |
| titanium | 0.01 max. |
| phosphorus | less than 0.05 |
| sulfur | less than 0.05 |
| carbon | 0.01 to 0.08 |
| nitrogen | 0.01 to 0.5 |
| oxygen | 0.005 to 0.1 |
| nickel | balance |

TABLE 8

| Element | Weight Percent |
|---|---|
| iron | 4 to 15 |
| chromium | 18 to 25 |
| molybdenum | 3 to 12 |
| niobium | 1 max. |
| vanadium | 0.05 to 3.0 |
| manganese | 1 max. |
| silicon | 1 max. |
| aluminum | 0.05 max. |
| titanium | 0.05 max. |
| phosphorus | less than 0.05 |
| sulfur | less than 0.05 |
| carbon | 0.01 to 0.08 |
| nitrogen | 0.01 to 0.5 |
| oxygen | 0.005 to 0.1 |
| nickel | balance |

Vanadium is important in certain aspects of the invention, as illustrated by alloy ABD5, to form vanadium carbides and/or nitrides for strengthening in the substantial absence of Al and Ti. In this regard, the substantial absence of Al and Ti is important to avoid formation of nickel aluminide or nickel/titanium aluminide intermetallic precipitates which would interfere with the strengthening action of the interstitials C and 0. In another aspect of the invention, as illustrated by alloy ABD2, such strengthening is replaced with strengthening by the gamma" phase ($Ni_3Nb$), so that the presence of niobium is required, although vanadium is not.

In addition to rapid solidification processing via atomization, which is important for achieving the fine and stable microstructure and associated improvements in mechanical properties, the preferred alloys of Table 6 are distinguished from commercial alloys 625 and 718 in the essential presence of V and the absence of significant amounts of the elements aluminum and titanium, and from the commercial Hastelloys C22 and C276 in the lower amounts of molybdenum and the absence of tungsten and cobalt and, in the case of C276, a higher carbon content in the inventive alloys. Compositionally, the alloys of Table 7 are distinguished from commercial alloy 625 by a higher Nb content, a lower Mo content, and by the substantial absence of Al and Ti; from alloy 718 by a lower iron content and the substantial absence of Al and Ti; and from the Hastelloys C22 and C276 by lower Mo and by the absence of W and Co. Compositionally, the alloys of Table 8 are distinguished from commercial alloy 625 by a higher iron content and lower Nb content, in the essential presence of the element vanadium and the substantial absence of aluminum and titanium; from alloy 718 by a lower iron content, lower Nb and by the essential presence of V and the substantial absence of Al and Ti; from alloy C22 by higher iron and lower Mo contents, and the absence of W and Co; and from alloy 276 by higher Cr, lower Mo, and the absence of W and Co, as well as a higher C content.

What is claimed is:

1. An improved nickel-base alloy of enhanced strength and corrosion resistance together with retained ductility comprising consolidated particles atomized from an alloy melt under cover of an inert gas and consisting essentially of, by weight percent:

| | |
|---|---|
| iron | 0 to 20 |
| chromium | 10 to 30 |
| molybdenum | 2 to 12 |
| niobium | 6 max. |
| vanadium | 0.05 to 3.0 |
| manganese | 0.8 max. |
| silicon | 0.5 max. |
| aluminum | less than 0.01 |
| titanium | less than 0.01 |
| phosphorus | less than 0.05 |
| sulfur | less than 0.05 |
| carbon | 0.01 to 0.08 |
| nitrogen | less than 0.2 |
| oxygen | 0.1 max. |
| nickel | balance. |

2. An improved nickel-base alloy of enhanced strength and corrosion resistance together with retained ductility comprising consolidated particles atomized from an alloy melt under cover of an inert gas and consisting essentially of, by weight percent:

| | |
|---|---|
| iron | 3 to 18 |
| chromium | 18 to 25 |
| molybdenum | 8 max. |
| niobium | 3.5 to 6.0 |
| vanadium | 3.0 max. |
| manganese | 1 max. |
| silicon | 1.0 max. |
| aluminum | 0.01 max. |
| titanium | 0.01 max. |
| phosphorus | less than 0.05 |
| sulfur | less than 0.05 |
| carbon | 0.01 to 0.08 |
| nitrogen | 0.01 to 0.5 |
| oxygen | 0.005 to 0.1 |
| nickel | balance. |

3. An alloy according to claim 2 in a heat-treated aged condition in which the alloy is strengthened by the precipitation of gamma" phase intermetallic ($Ni_3Nb$).

4. An alloy according to claim 3, wherein the alloy is in a strengthened condition after aging at a temperature from about 600° C. to about 700° C. for at least about 50 hours.

5. An improved nickel-base alloy of enhanced strength and corrosion resistance together with retained ductility comprising consolidated particles atomized from an alloy melt under cover of an inert gas and consisting essentially of, by weight percent:

| | |
|---|---|
| iron | 4 to 15 |
| chromium | 18 to 25 |

-continued

| | |
|---|---|
| molybdenum | 3 to 12 |
| niobium | 1 max. |
| vanadium | 0.05 to 3.0 |
| manganese | 1 max. |
| silicon | 1 max. |
| aluminum | 0.05 max. |
| titanium | 0.05 max. |
| phosphorus | less than 0.05 |
| sulfur | less than 0.05 |
| carbon | 0.01 to 0.08 |
| nitrogen | 0.01 to 0.5 |
| oxygen | 0.005 to 0.1 |
| nickel | balance. |

6. An improved nickel-base alloy of enhanced strength and corrosion resistance together with retained ductility comprising consolidated particles atomized from an alloy melt under cover of an inert gas and consisting essentially of, by weight percent:

| | |
|---|---|
| iron | 15 |
| chromium | 25 |
| molybdenum | 3 |
| niobium | 5.5 |
| vanadium | 3.0 max. |
| manganese | 1 max. |
| silicon | 1 max. |
| carbon | 0.01 to 0.08 |
| nitrogen | 0.01 to 0.5 |
| oxygen | 0.005 to 0.1 |
| nickel | balance, except for incidental impurities. |

7. An improved nickel-base alloy of enhanced strength and corrosion resistance together with retained ductility comprising consolidated particles atomized from an alloy melt under cover of an inert gas and consisting essentially of, by weight percent:

| | |
|---|---|
| iron | 4 |
| chromium | 25 |
| molybdenum | 10 |
| niobium | 0.5 |
| vanadium | 0.5 |
| manganese | 1 max. |
| silicon | 1 max. |
| carbon | 0.01 to 0.08 |
| nitrogen | 0.01 to 0.5 |
| oxygen | 0.005 to 0.1 |
| nickel | balance, except for incidental impurities. |

* * * * *